US006962275B2

(12) United States Patent
deCler et al.

(10) Patent No.: US 6,962,275 B2
(45) Date of Patent: Nov. 8, 2005

(54) FLUID COUPLING WITH DISPOSABLE CONNECTOR BODY

(75) Inventors: Charles Peter deCler, Stillwater, MN (US); Robert K. Johnson, Blaine, MN (US)

(73) Assignee: Colder Products Company, St. Paul, MN (US)

( * ) Notice: Subject to any disclaimer, the term of this patent is extended or adjusted under 35 U.S.C. 154(b) by 149 days.

(21) Appl. No.: 10/441,627

(22) Filed: May 19, 2003

(65) Prior Publication Data

US 2004/0232175 A1 Nov. 25, 2004

(51) Int. Cl.[7] ..... B65D 35/00

(52) U.S. Cl. ..... 222/570; 222/83; 222/105; 222/541.2; 222/567; 251/149.1

(58) Field of Search ..... 222/81, 83, 83.5, 222/88, 92, 105, 570, 541.2, 566, 567; 251/149.1; 141/329, 330, 348, 349, 346, 351–354

(56) References Cited

U.S. PATENT DOCUMENTS

| | | | | | |
|---|---|---|---|---|---|
| 4,582,223 | A | * | 4/1986 | Kobe | 222/82 |
| 4,709,835 | A | * | 12/1987 | Kruger et al. | 222/87 |
| 5,111,970 | A | * | 5/1992 | Rutter et al. | 222/83 |
| 5,816,298 | A | * | 10/1998 | Stricklin et al. | 141/346 |
| 5,884,648 | A | * | 3/1999 | Savage | 137/1 |
| 6,179,173 | B1 | * | 1/2001 | Frazier et al. | 222/573 |
| 6,427,872 | B1 | * | 8/2002 | Anderson | 222/83 |
| 6,607,097 | B2 | * | 8/2003 | Savage et al. | 222/1 |
| 6,612,545 | B1 | * | 9/2003 | Rutter et al. | 251/149.6 |
| 6,644,510 | B2 | * | 11/2003 | Kawolics et al. | 222/105 |
| 2003/0136932 | A1 | * | 7/2003 | Doyle | 251/149.1 |

FOREIGN PATENT DOCUMENTS

| | | |
|---|---|---|
| EP | 0 056 016 | 7/1982 |
| FR | 2 528 806 | 12/1983 |
| GB | 2 077 243 | 12/1981 |
| GB | 2 183 617 | 6/1987 |

* cited by examiner

*Primary Examiner*—J. Casimer Jacyna
(74) *Attorney, Agent, or Firm*—Merchant & Gould P.C.

(57) ABSTRACT

A coupling apparatus for fluid dispensing with a disposable connector on the fluid line or fluid dispensing system side. The coupling apparatus includes an insert body that is connectable with a disposable connector device. The insert body includes a recess area defined between a first inner sidewall and a second inner sidewall. The second inner sidewall extends coaxially with the first inner sidewall, and has an aperture defining an opening through a first and second end. The connector device includes a connector body connected with an adapter portion. The connector body includes a beveled end that is insertable through the aperture of the second inner sidewall. The adapter portion is disposed proximate and extends past the beveled end, where the beveled end is recessed within the adapter portion. An insertion space is defined between the beveled end and an outer wall defined by the adapter portion. The adapter portion is insertable into the recess area and the insertion space is receivable of the second inner sidewall.

18 Claims, 5 Drawing Sheets

FLUID COUPLING WITH DISPOSABLE CONNECTOR BODY

FIELD OF THE INVENTION

The present invention relates generally to a coupling for fluid dispensing. More particularly, the present invention relates to a fluid coupling with a disposable connector body on the fluid line or fluid dispensing system side that connects with a fluid source.

BACKGROUND OF THE INVENTION

A variety of couplings and connectors are employed for fluid dispensing and are widely used in powered or gravity dispensing systems, for instance, in the dispensing of non-shelf stable food items.

Typically, these fluid couplings use connection types that include an insert and/or cap connected with a fluid source, such as a bag or bag-in-box. The insert is coupled with a connector or coupler body that can access a fluid dispensing system, such as a fluid line. Many times, such connectors employ a piercing member at one end so as to puncture a membrane seal disposed on the insert when the connector is mated with the insert for fluid dispensing. Further, such connectors used to mate with the insert on the fluid source are produced so as to be reusable.

However, such couplings can become contaminated, particularly on the reusable connector side where contamination problems can occur after dispensing from a fluid source, such as dairy products and other non-shelf stable food items requiring clean environments. For instance after dispensing is finished, such reusable connectors or couplers are mated with another insert body on a filled food source and may carry contaminants left from the previously emptied food source. Further, such connectors still lack suitable structures to prevent product entrapment and product spill during connection from the food source insert or cap.

Therefore to prevent such contamination issues, there is a need to provide a coupler apparatus with a connector device on the dispensing side that is disposable after one time use, while providing a coupler that is conveniently produced in a cost effective manner. Further, there is a need to provide a connector device with improved structure for maintaining suitable seal and retention qualities during connection with a fluid source containing food items for dispensing.

SUMMARY OF THE INVENTION

In accordance with the present invention, improvements upon existing fluid coupling designs have been made by providing a coupling apparatus with a disposable connector device on the dispensing side that is further directed to preventing contamination during connection.

In one embodiment of the present invention, a coupling apparatus includes an insert body that is connectable to a fluid source and a disposable connector device connectable to a fluid dispensing system. The insert body includes first and second ends with a recess area extending from the second end toward the first end. The recess area is defined between a first inner sidewall and a second inner sidewall. The second inner sidewall is connected at the first end, and extends coaxially with the first inner sidewall toward the second end. The second inner sidewall has an aperture proximate the second end, and defines an opening through the first and second ends. The connector device is connectable with the second end of the insert body and includes a connector body connected with an adapter portion. The connector body includes first and second ends with an opening therethrough, where the first end is formed as a beveled end that is insertable through the aperture of the second inner sidewall. The adapter portion defines an outer wall disposed proximate the beveled end and extends past the beveled end, such that the beveled end is recessed within the adapter portion. An insertion space is defined between the beveled end and the outer wall. The outer wall is insertable into the recess area and the insertion space is receivable of the second inner sidewall, so as to retain and seal the connector device with the insert body when connected in a dispensing position.

When in the dispensing position, the opening of the insert body and the opening of the connector device define a flow passage therethrough so as to dispense from a fluid source through the coupling apparatus to a fluid dispensing system.

In one embodiment, the insert body includes a protective cap disposed at the second end and covers the recess area and second inner sidewall.

In one embodiment, the second inner sidewall includes a sealing membrane disposed over the aperture and connected to the second inner sidewall proximate the second end of the insert body, where the sealing membrane defines a puncture seal. Preferably, the second inner sidewall is recessed within the second end.

In one embodiment, the insert body includes at least one support member disposed at the first end and opposite the recess area, where the at least one support member is connected between the first and second inner sidewalls. Preferably, the at least one support member being at least one brace extending in a direction transverse to the first and second inner sidewalls. More preferably, the at least one support member includes a plurality of braces.

In another embodiment, the connector body and the adapter portion are integrally formed as a single piece structure requiring no assembly. Preferably, the connector body and adapter portion are integrally molded.

In another embodiment, the connector body and the adapter portion are formed as a two piece structure, the outer wall of the adapter portion being a tubing member with the connector body inserted therein, where the insertion space is defined between an inner sidewall of the tubing member and the beveled end of the connector body.

In yet another embodiment, the connector device includes at least one retention barb connected to at least one of the connector body and adapter portion.

In yet another embodiment, the connector device is disposable after one time use. Preferably, at least the connector body is disposable after one time use.

The present invention provides a fluid coupling apparatus with improved connection capabilities and a connector on the dispensing side that is disposable after one time use to maintain cleanliness and prevent contamination. The coupling apparatus provides a recessed beveled end on the connector device so that connection is initiated before the membrane on the insert body is punctured, thereby preventing spill and squirting during connection. Further, the retention barb structures help avoid entrapment of product or a stagnant area by providing suitable seal and retaining properties.

A variety of additional advantages and objects of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the illustrated embodiments, reference is made to the accompanying drawings that form a part hereof, and in which is shown by way of illustration of the embodiments in which the invention may be practiced. It is to be understood that other embodiments may be utilized as structural changes may be made without departing from the spirit and scope of the present invention.

Figure 1A:
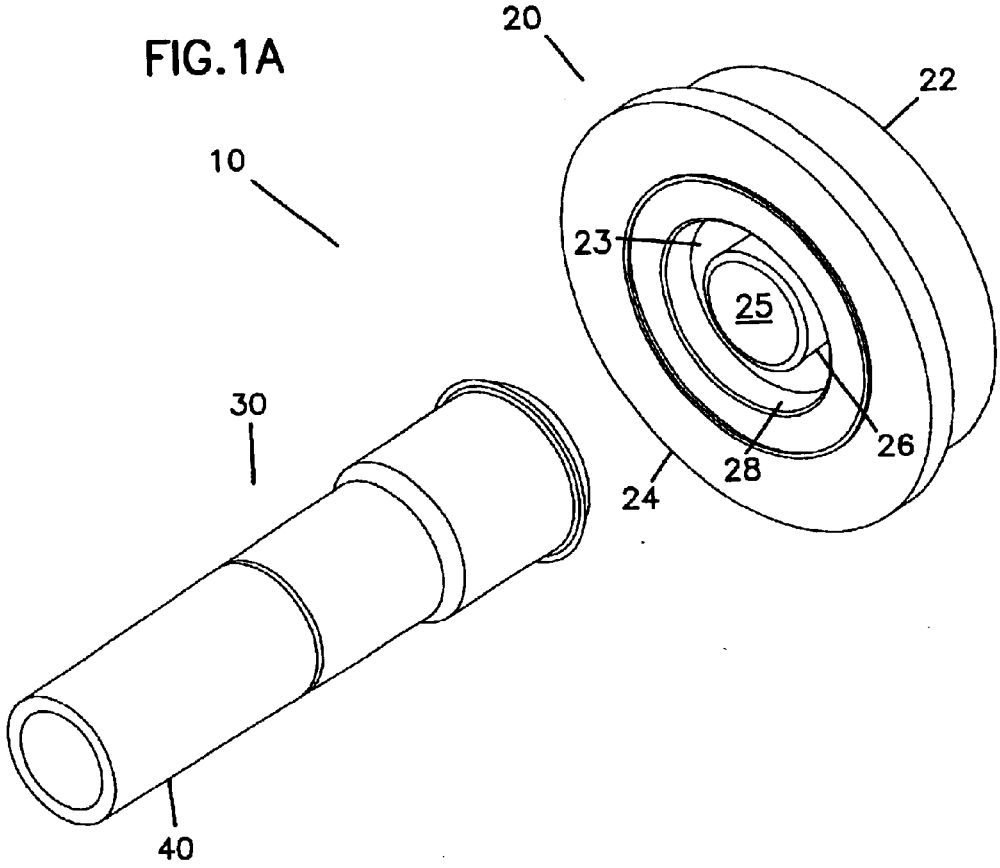
FIG. 1A represents a perspective view of a first embodiment of a coupling apparatus including an insert body and a connector device in a pre-dispensing position in accordance with the principles of the present invention.
Figure 1B:
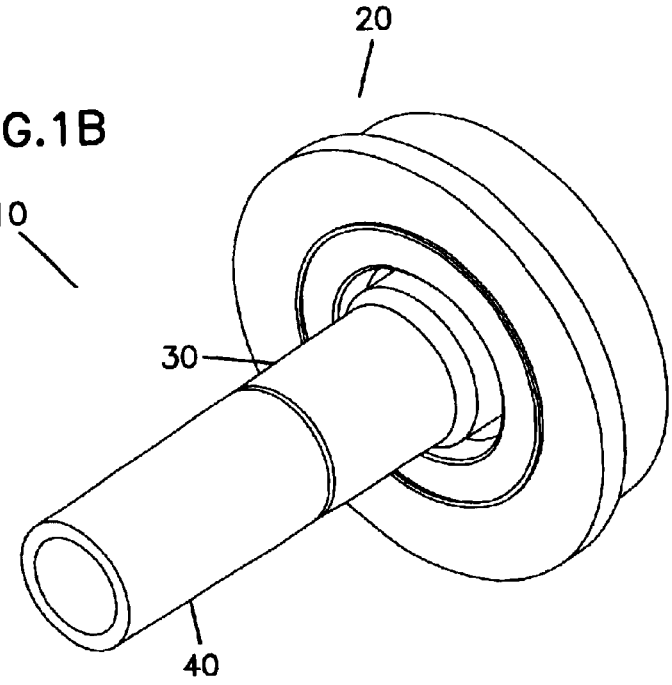
FIG. 1B represents another perspective view of the coupling apparatus of FIG. 1A in a dispensing position in accordance with the principles of the present invention.

FIGS. 1A through 4 illustrate one preferred embodiment of a coupling apparatus 10 in accordance with the present invention. FIGS. 1A and 1B show the coupling apparatus 10 in a non-dispensing configuration and a dispensing configuration, respectively. The coupling apparatus includes an insert body 20 connectable with a connector device 30. Preferably, the insert body 20 is adaptable for connection with a fluid source including but not limited to a conventionally used bag or bag-in-box filled with foodstuffs, such as dairy products, beverages or other non-shelf stable food items in need of dispensing support. More preferably, the insert body 20 is adaptable for connection to a fluid source as a cap on a fitment of the fluid source and is removable for filling purposes. It will be appreciated that various well known structures, such as threaded connections, plug and groove and/or socket fittings (FIG. 3B), multi-position snap arrangements and the like, may be used in order to provide connection of the insert body 20 with a fluid source. The connector device 30 is shown attached to a fluid delivery line 40, which may be a dispensing tube. Preferably, the connector device 30 is adaptable for connection with a fluid delivery system such as through a fluid delivery line or tube. More preferably, the connector device 30 is connectable through a fluid delivery line 40 to a fluid delivery system for gravity or pumped dispensing.

More preferably, the insert body 20 and the connector device 30 are mateably connected to one another and are formed of plastic material. For example, the connector device 30 may be formed of a plastic material, such as but not limited to ABS plastic material or high density polyethylene. Preferably, the insert body 20 is formed of a softer plastic material than the connector device 30 and having a lower durometer. The insert body 20 and the connector device 30 may be formed as molded parts. Preferably, the fluid delivery line 40 is a low durometer tubing made from well-known material used in food tubing, such as but not limited to a thermoplastic elastomer, silicone or latex material.

Figure 2:
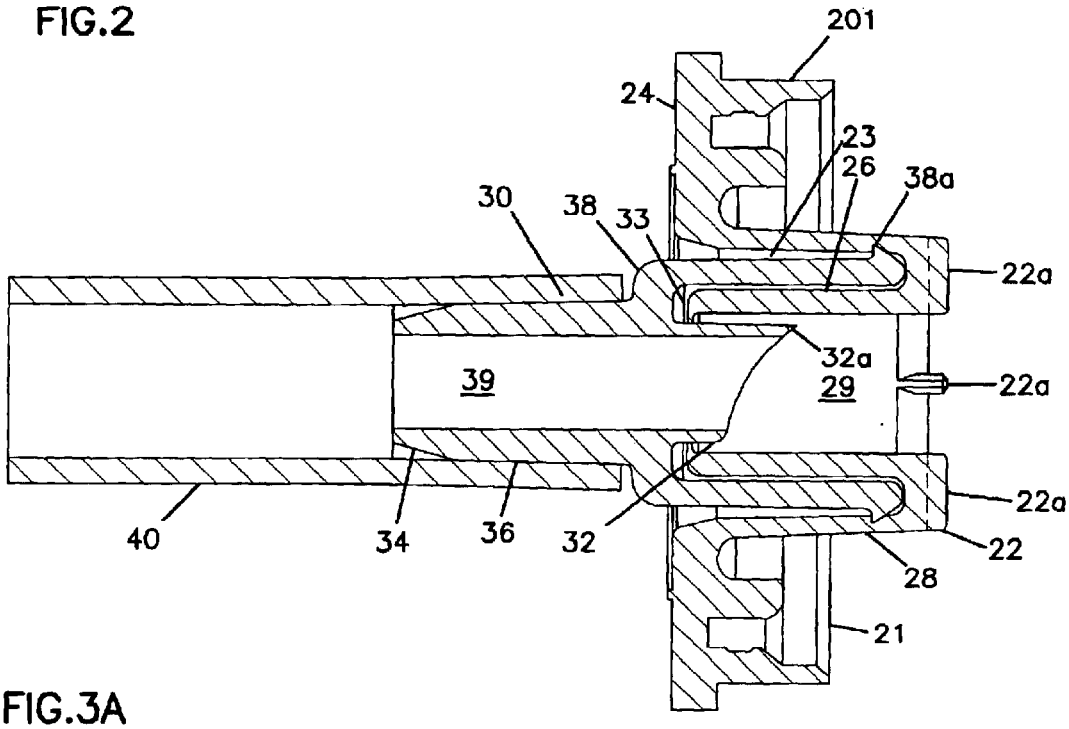
FIG. 2 represents a sectional view of the coupling apparatus of FIG. 1B illustrating the connector device having one embodiment of a fluid dispensing tube attached thereto.

FIG. 2 illustrates a sectional view of the coupling apparatus 10 in a dispensing position. The insert body 20 includes a first end 22 and a second end 24. A recess area 23 extends from the second end 24 toward the first end 22. The recess area 23 is defined between a first inner sidewall 28 and a second inner sidewall 26. The second inner sidewall 26 extends coaxially with the first inner sidewall 28, and is connected at the first end 22 extending toward the second end 24. Preferably, the recess area 23 resembles a radial shaped well between the first and second inner sidewalls 28 26, and is receivable for insertion of the connector device 30. The second inner sidewall 26 also includes an aperture 26*a* proximate the second end 24, and defines an opening 29 through the first and second ends 22, 24. Preferably, the aperture 26*a* defines an opening 29 coaxial with the first and second sidewalls 28, 26.

Figure 3A:
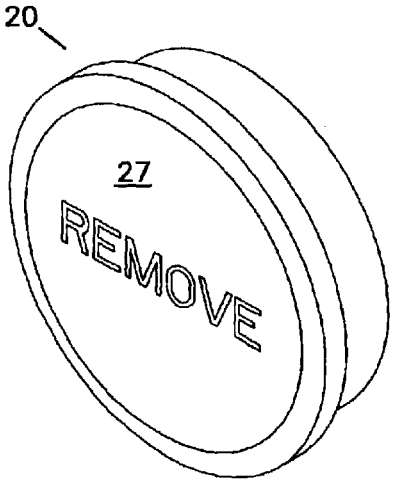
FIG. 3A represents a perspective view of the insert body alone of FIG. 1A with one embodiment of a protective cap connected thereon.
Figure 3B:
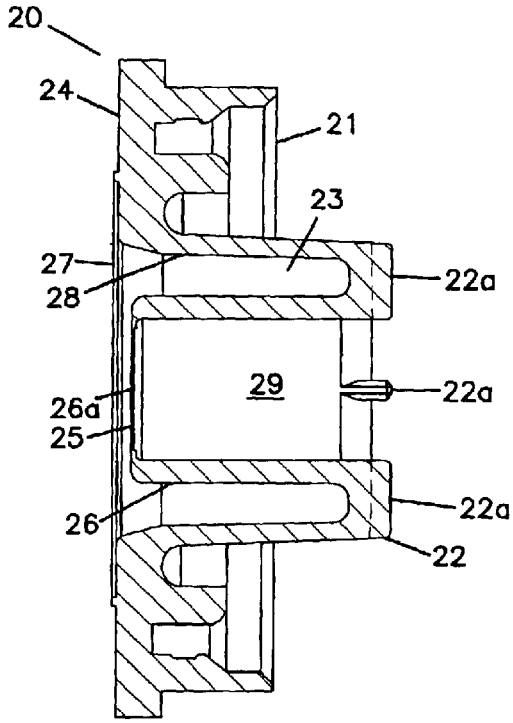
FIG. 3B represents a sectional view of the insert body alone of FIG. 3A with one embodiment of a sealing membrane connected thereon.

Proximate the first end 22 and at the fluid source side, the insert body 20 includes a connection structure 21 so as to be adaptable to a fitment on a fluid source and for capping a fluid source. As illustrated in FIGS. 2 and 3B, the connection structure 21 may employ conventionally used socket fittings so as to partially insert the insert body 20 as a cap into a fitment of the fluid source. It will be appreciated that any well-known connection structure may be employed for connecting the insert body 20 to a fluid source and is not limited to the exemplary connection structure illustrated.

The first end 22 also includes at least one support member 22*a* disposed opposite the recess area 23 and connected between the first and second sidewalls 28, 26. Preferably and as illustrated in FIGS. 2 and 3B, a plurality of support members 22*a* are formed as braces at the first end 22, and extend in a direction transverse to the first inner sidewall 28 and the second inner sidewall 26. The support members 22*a* provide strength and reinforcement of the recess area 23 and the first and second inner sidewalls 28, 26. Such a structure and configuration is useful to maintain the well shape of the recess area 23 and to prevent rolling and flexing of the inner sidewalls 26, 28 when the connector device 30 is being coupled to the insert body 20. More particularly, the support members 22*a* prevent the second inner sidewall 26 from deformation, such as rolling inward or otherwise bending when the connector device 30 is received. Preferably, at least one pair of oppositely disposed braces is employed. As illustrated in FIGS. 2 and 3, four braces as two oppositely disposed pairs are employed (fourth not shown in section). It will be appreciated that additional braces could be used as needed in order to provide the desired reinforcement. Preferably, the recess area 23 and inner sidewalls 26, 28 are formed so as to prevent deformation at an insertion force of about 2–20 lbs, and more preferably about 5 lbs.

In a non-dispensing position, the insert body 20 includes sealing structures to maintain the insert body 20 in a closed, sealed configuration when in the non-dispensing position. As illustrated in FIGS. 3A–3B, the insert body 20 includes a protective cap 27 disposed at the second end 24 and covers the recess area 23 and second inner sidewall 26. It will be appreciated that a protective cap instead may be disposed proximate the first end 22 and over a fitment at the fluid source. Preferably, the protective cap 27 is heat sealed or welded over the second end 24. It will be appreciated the protective cap 27 can be formed as a tear away seal or any other well known configuration for closing an insert body. A sealing membrane 25 is disposed over the aperture 26*a*, and is connected about the second inner sidewall 26 proximate the second end 24. Preferably, the sealing membrane 25 is a puncture seal, where the second inner sidewall 26 and membrane seal 25 are recessed within the second end 24. The membrane seal 25 is breakable when pierced by the connector device 30 during connection. The recessed structure of the second inner sidewall 26 and the membrane seal 25 are further discussed below.

Figure 4:
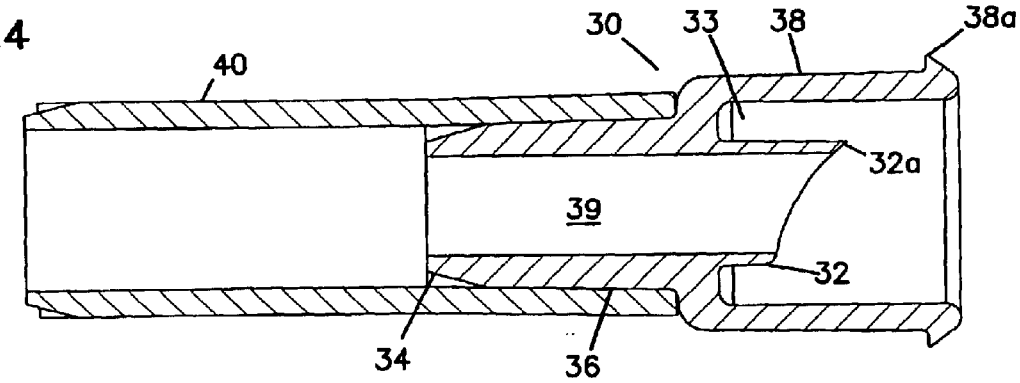
FIG. 4 represents a sectional view of the connector device alone of FIG. 2.

FIGS. 2 and 4 illustrate the connector device 30. The connector device 30 includes a connector body 36 connected with an adapter portion 38. The connector body 36 includes a first end 32 and a second end 34. The second end 34 is connectable with a fluid delivery system, such as a fluid line or tube 40. The connector body 36 defines an opening 39 through the first and second ends 32, 34. Preferably, the first end 32 is formed as a beveled end 32*a*. The beveled end 32*a* may be tapered with a sharp edge for piercing the membrane seal structure 25 of the insert body 20. The adapter portion 38 is formed as an outer wall proximate the beveled end 32*a*. The adapter portion 38 includes a shoulder portion extending radially outward from the connector device 36, and extends past the beveled end 32*a*, such that the beveled end 32*a* is recessed within the adapter portion 38.

An insertion space 33 is defined between the beveled end 32*a* and the outer wall formed by the adapter portion 38. The adapter portion 38 is insertable into the recess area 23 of the insert body 20, and the insertion space is receivable for the second inner sidewall 26 when the connector device 30 and the insert body are connected into the dispensing position.

A retention barb 38*a* is disposed proximate the first end 32 and is engageable with the insert body 20 for sealing and retaining the connector device 30 to the insert body 20. Preferably as illustrated in FIGS. 2 and 4, the retention barb 38*a* is disposed at an end of the adapter portion 38 so as to engage with the first inner sidewall 28. It will be appreciated that a retention barb may be disposed in other locations for engaging with the second inner sidewall, such as on the connector body as described in the second preferred embodiment below. Preferably, the retention barb 38*a* engages at least one of the inner sidewalls 26, 28 only, where the fluid line does not contact the receiving and inserting portions of the connector apparatus 10. The retention barb 38*a* structure provides a connection that is a part line free sealing configuration having no longitudinal part line included at sealing surfaces, such as between the openings 29, 39 of the insert body 20 and the connector device 30. Thus, contamination can further be avoided while maintaining an appropriate seal even under high volume manufacturing conditions.

Preferably, the connector device 30 and the insert body 20 are connected in an interference fit configuration. In operation, the adapter portion 38 and retention barb 38*a* are inserted into the insert body 20, and form an interference fit with the first inner sidewall 28 and the recess area 23 of the insert body 20. The first end 32 and beveled end 32*a* snugly fit into the aperture 26*a*, and the second inner sidewall 26 is received by the insertion space 33 formed by the adapter portion 38 and the connector body 36. When connected, the beveled end 32*a* pierces the membrane seal 25 of the aperture 26*a* in the second inner sidewall 26. The recessed structure of the beveled end 32*a* and the second inner sidewall 26 enable a sealed connection to be formed between the connector device 30 and the insert body 20 before the membrane seal 25 is pierced. Further, this configuration avoids spill, squirting and entrapment of product during and between connection. When coupled, the opening 39 of the connector device 30 and the opening 29 of the insert body are in fluid communication allowing a flow passage for dispensing of product from a fluid source.

As above, the connector device 30 can be formed as a molded plastic material suitable for one time use and disposable thereafter. Preferably in the embodiment illustrated in FIGS. 1A through 4, the connector body 36 and the adapter portion 38 are formed as a single integrally molded piece requiring no assembly, and are disposable after one time use. Thus, the coupling apparatus 10 of the present invention provides a simple connector device 36 having seal and retaining capabilities during connection and before dispensing is enabled. The support members 22*a* provide suitable reinforcement of the inner sidewalls 26, 28 and the recess area 23, such that mating with the connector device 36 does not cause deformation. Further, the present invention provides a cost effective connector on the dispensing side that can be discarded after one time use so as to avoid contamination problems associated with reuse and reconnection with another fluid source.

Figure 5A:
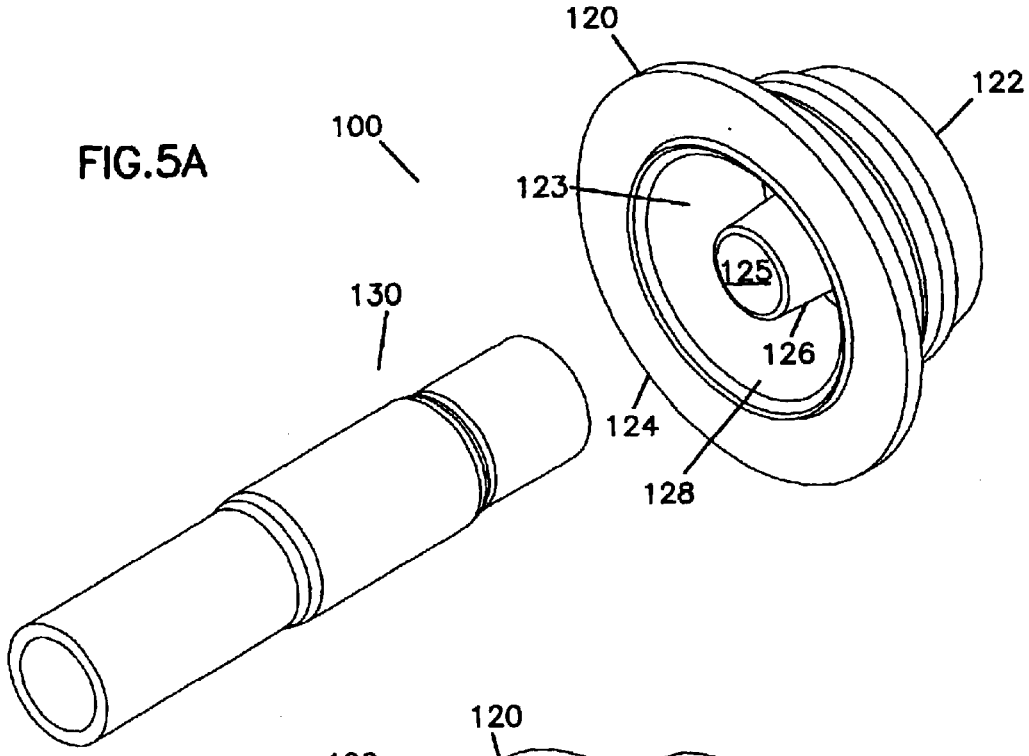
FIG. 5A represents a perspective view of a second embodiment of a connector apparatus including an insert body and a connector device in a pre-dispensing position in accordance with the principles of the present invention.
Figure 5B:
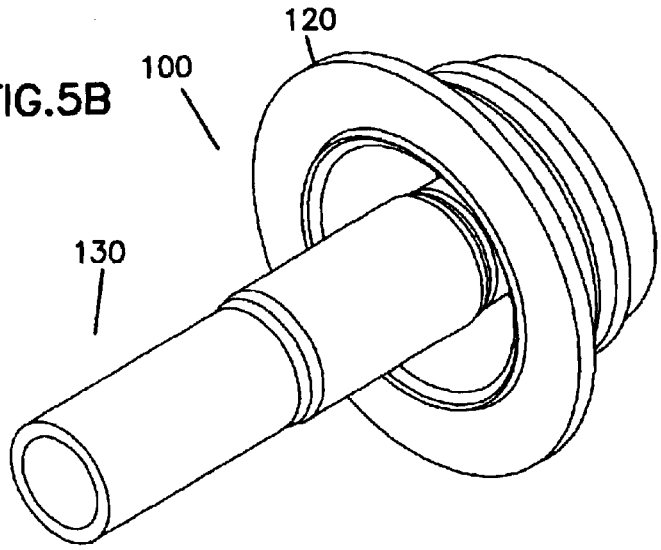
FIG. 5B represents a perspective view of the connector apparatus of FIG. 5A in a dispensing position in accordance with the principles of the present invention.

In a second preferred embodiment, a coupling apparatus 100 is illustrated in FIGS. 5A through 8C. FIGS. 5A and 5B show the coupling apparatus 100 in a non-dispensing configuration and a dispensing configuration, respectively. The coupling apparatus 100 includes an insert body 120 connectable with a connector device 130. Preferably, the insert body 120 is adaptable for connection with a fluid source including but not limited to a conventionally used bag or bag-in-box filled with foodstuffs, such as dairy products, beverages or other non-shelf stable food items in need of dispensing support. More preferably, the insert body 120 is adaptable for connection to a fluid source as a cap on a fitment of the fluid source, and is removable for filling purposes. It will be appreciated that various well known structures, such as threaded connections, multi-position snap arrangements (FIGS. 8A–8C), plug and groove and/or socket fittings and the like, may be used in order to provide connection of the insert body 120 with a fluid source. The connector device 130 is adaptable for connection with a fluid delivery system such as through a fluid delivery line or tube. Preferably, the connector device 130 is connectable through a fluid delivery line to a fluid delivery system employing gravity or pumped dispensing.

More preferably, the insert body 120 and the connector device 130 are mateably connected to one another and are formed of plastic material. For example, the connector device 130 may be formed of a plastic material, such as but not limited to ABS plastic material or high density polyethylene. Preferably, the insert body 120 is formed of a softer plastic material than the connector device 130 and having a lower durometer. The insert body 120 and the connector device 130 may be formed as molded parts.

Figure 6:
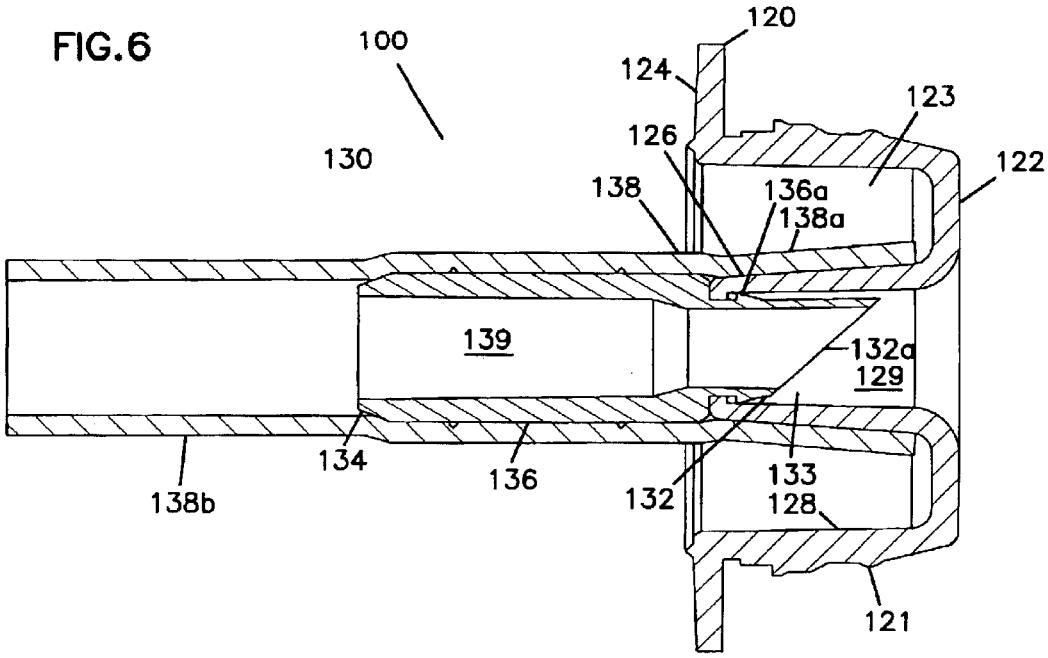
FIG. 6 represents a sectional view of the coupling apparatus of FIG. 5B.

FIG. 6 illustrates a sectional view of the coupling apparatus 100 in a dispensing position. The insert body 120 includes a first end 122 and a second end 124. A recess area 123 extends from the first end 122 toward the second end 124. The recess area 123 is defined between a first inner sidewall 128 and a second inner sidewall 126. The second inner sidewall 126 extends coaxially with the first inner sidewall 128, and is connected at the first end 122 extending toward the second end 124. Preferably, the recess area 123 resembles a radial shaped well between the first and second inner sidewalls 128, 126, and is receivable for insertion of the connector device 130. The second inner sidewall 126 also includes an aperture 126*a* proximate the second end 124 and defining an opening 129 through the first and second ends 122, 124. Preferably, the aperture 126*a* defines an opening 129 coaxial with the first and second sidewalls 128, 126.

Figure 8A:
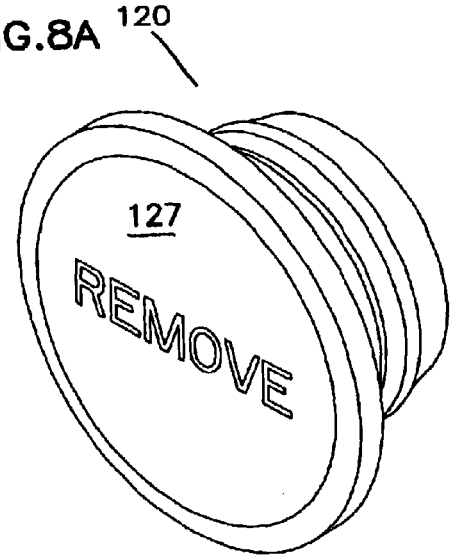
FIG. 8A represents a perspective view of the insert body alone of FIG. 5A with one embodiment of a protective cap connected thereon.
Figure 8B:
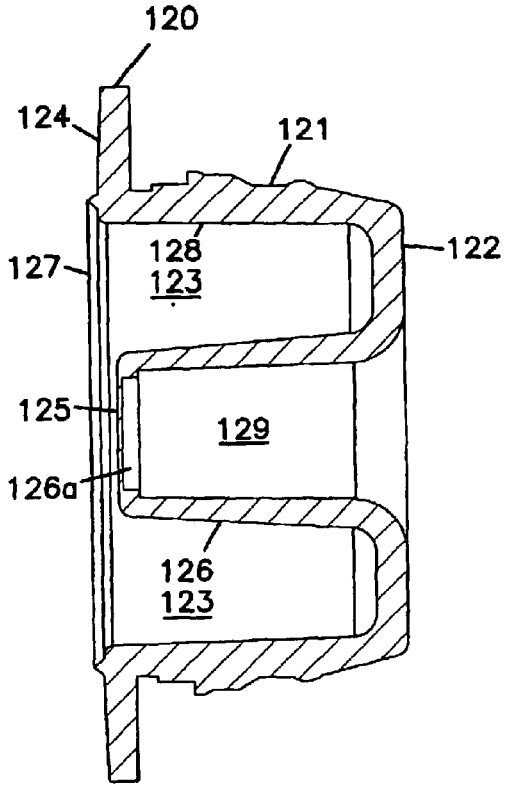
FIG. 8B represents a sectional view of the insert body alone of FIG. 8A with one embodiment of a sealing membrane connected thereon.
Figure 8C:
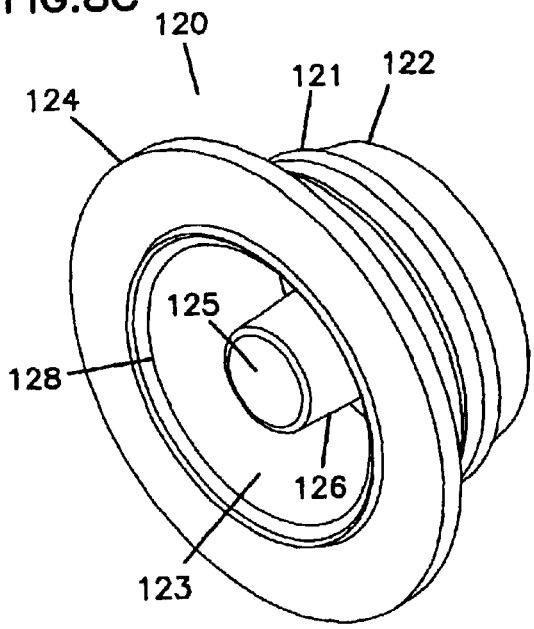
FIG. 8C represents a perspective view of the insert body alone of FIG. 8A illustrated without the protective cap in a pre-dispensing position.

Proximate the first end 122 and at the fluid source side, the insert body 120 includes a connection structure 121 so as to be adaptable to a fitment of a fluid source and for capping a fluid source. As illustrated in FIG. 8A through 8C, the connection structure 121 may employ a multi-position snap arrangement. The multi-position snap arrangement illustrates the connection structure 121 with multiple protrusions that can correspond with mating structures on a fluid source to snap the insert body 120 and fluid source together. The multiple protrusions of the connection structure 121 provide at least a partial snap position where the insert body 120 is partially inserted in a fluid source, such as during shipment and to allow filling. Further, at least a full insert position is provided where the insert body 120 can be fully inserted in a fluid source after filling. It will be appreciated that any well-known connection structure may be employed for connecting the insert body 120 to a fluid source and is not limited to the exemplary connection structure shown.

One difference of this embodiment from the embodiment illustrated in FIGS. 1A though 4 is that the support member and brace structures 22*a* are not illustrated. It will be appreciated that the support members structures, such as braces 22*a*, are not limited to the first embodiment and also could be formed in the same manner with respect to the recess 123 and first and second inner sidewalls 128, 126 illustrated in the embodiment of FIGS. 5A through 8C. Employing such support members provides similar advantages, as discussed above, which include providing strength and reinforcement of the recess area and the first and second inner sidewalls. Such a structure and configuration can maintain the well shape of the recess area and prevent rolling and flexing of the inner sidewalls when the connector device is being coupled to the insert body. Further, the support members can prevent the second inner sidewall from deformation, such as rolling inward or otherwise bending when the connector device is received. Preferably, the recess area and inner sidewalls are formed so as to prevent deformation at an insertion force of about 2–20 lbs, and more preferably about 5 lbs.

In a non-dispensing position, the insert body 120 includes sealing structures to maintain the insert body 120 in a closed, sealed configuration when connected with a fluid source. As illustrated in FIGS. 8A through 8C, the insert body 120 includes a protective cap 127 disposed at the second end 124 and covers the recess are 123 and second inner sidewall 126. It will be appreciated that a protective cap instead may be disposed proximate the first end 22 and over the fitment of a fluid source. Preferably, the protective cap 127 is heat-sealed or welded at the second end 124. It will be appreciated the protective cap 127 can be formed as a tear away seal or any other well known configuration for closing an insert body 120. A sealing membrane 125 is disposed over the aperture 126*a*, and is connected about the second inner sidewall 126 proximate the second end 124. Preferably, the sealing membrane 125 is a puncture seal, where the second inner sidewall 126 and membrane seal 125 are recessed within the second end 124. The membrane seal 125 is breakable when pierced by the connector device 130 during connection.

Figure 7A:
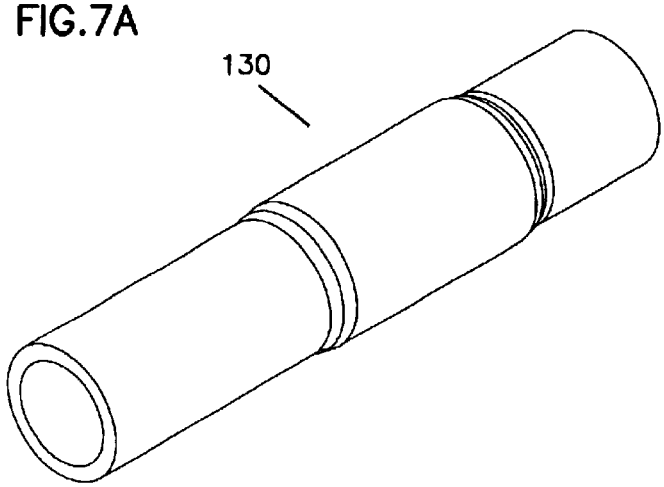
FIG. 7A represents a perspective view of the connector device alone of FIG. 5A.
Figure 7B:
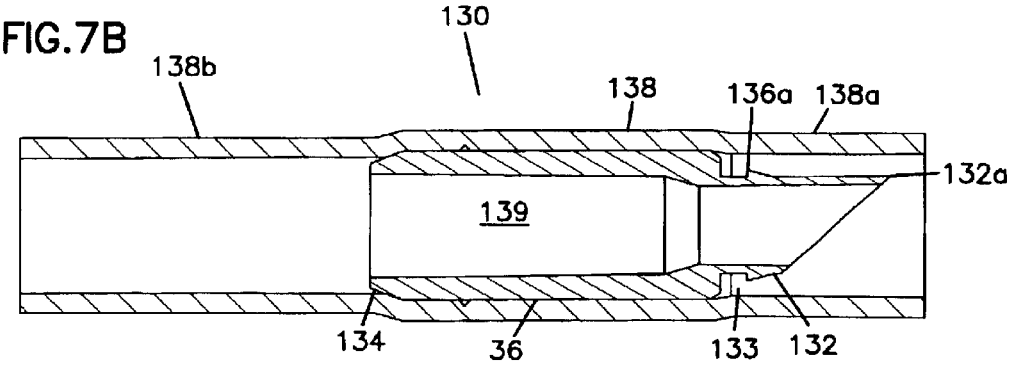
FIG. 7B represents a sectional view of the connector device of FIG. 7A.

FIGS. 6 and 7A–7B illustrate a second preferred embodiment of the connector device 130. The connector device 130 includes a connector body 136 connected with an adapter portion 38. The connector device includes a first end 132 and a second end 134. The connector body 136 defines an opening 139 through the first and second ends 132, 134. Preferably, the first end 132 is formed as a beveled end 132*a* tapered with a sharp edge for piercing the membrane seal structure 125 of the insert body 120. The first end 132 has a portion defined with a smaller diameter than a portion proximate the second end 134 that forms a shoulder portion further discussed below. Preferably, the adapter portion 138 is a portion of tubing with the connector body 136 inserted therein. The adapter portion 138 is provided with an outer wall 138*a* that is proximate the beveled end 132*a*, and extends past the beveled end 132*a*, such that the beveled end 132*a* is recessed within the adapter portion 138.

An insertion space 133 is defined between the beveled end 132*a* and the outer wall 138*a* formed by the adapter portion 138. The shoulder portion of the first end 132 creates the insertion space located between the beveled end 132*a* and the adapter portion 138. The adapter portion 138 is insertable into the recess area 123 of the insert body 120, and the insertion space 133 is receivable for the second inner sidewall 126 when the connector device 130 and the insert body 120 are connected into the dispensing position.

A retention barb 136*a* is disposed proximate the first end 132 of the connector body 136 and is engageable with the insert body 120 for sealing and retaining the connector device 130 to the insert body 120. Preferably as illustrated in FIGS. 6 and 7B, the retention barb 136*a* is disposed at the first end 132 of the connector body and engages the second inner sidewall 126. It will be appreciated that a retention barb may be disposed in other locations for engaging with the second inner sidewall, such as on the adapter portion as described in the first preferred embodiment above. Further, it will be appreciated that retention barbs may be disposed on both the adapter portion and the connector body. Preferably, the retention barb 136*a* engages at least one of the inner sidewalls 126, 128 only, where the fluid line does not contact the receiving and inserting portions of the connector apparatus 100. The retention barb 136*a* structure provides a connection that is a part line free sealing configuration having no longitudinal part line included at sealing surfaces, such as between the openings 129, 139 of the insert body 120 and the connector device 130. Thus, contamination can further be avoided while maintaining an appropriate seal even under high volume manufacturing conditions.

Preferably, the adapter portion 138 is formed of a low durometer tubing made from well-known material used in food tubing, such as but not limited to a thermoplastic elastomer, silicone or latex material. The adapter portion 138 may be the fluid line itself connected to a fluid dispensing system, or may be a separately connected tubing portion connectable with another fluid line or tubing.

Preferably, the connector device 130 and the insert body 120 are connected in an interference fit configuration. In operation, the adapter portion 138 is inserted into the recess area 123 of the insert body 120 and forms an interference fit through a preload of the adapter portion where the tubing flexibly stretches about the second inner sidewall 126. The first end 132 and beveled end 132*a* snugly fit into the aperture 126*a*, and the retention barb 136*a* seals and retains the connector device 130 with the insert body 120. The second inner sidewall 126 is received by the insertion space 133 formed by the adapter portion 138 and the connector body 136. When connected, the beveled end 132*a* pierces the membrane seal 125 of the aperture 126*a* in the second inner sidewall 126. The recessed structure of the beveled end 132*a* and the second inner sidewall 126 enable a sealed connection to be formed between the connector device 130 and the insert body 120 before the membrane seal 125 is pierced. This configuration avoids spill, squirting and entrapment of product during and between connection. When coupled, the opening 139 of the connector device 130 and the opening 129 of the insert body 120 are in fluid communication allowing a flow passage for dispensing of product from a fluid source.

As above, the connector device 130 can be formed as a molded plastic material suitable for one time use and disposable thereafter. Preferably in the embodiment illustrated in FIGS. 5A through 5C, the connector body 136 and the adapter portion 138 are formed as a two-piece structure, where at least the connector body 136 is disposable and the adapter portion 138 is a tubing portion with the connector body 136 inserted therein. Similar to the embodiment illustrated in FIGS. 1A through 4, the coupling apparatus 100 provides a simple connector device 130 having seal and retaining capabilities during connection and before dispensing is enabled. Further, the present invention provides a cost effective connector on the dispensing side that can be discarded after one use so as to avoid contamination problems associated with reuse and reconnection with another fluid source.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A coupling apparatus for fluid dispensing, comprising an insert body including a first end and a second end, said insert body having a recess area extending from said second end toward said first end, said recess area being defined between a first inner sidewall and a second inner sidewall connected at said first end and extending coaxially with said first inner sidewall toward said second end, said second inner sidewall having an aperture proximate said second end defining an opening through said first and second ends; and a connector device being connectable with said insert body, said connector device including a connector body having first and second ends with an opening therethrough, said first end being formed as a beveled end being insertable into said second inner sidewall, and an adapter portion connected with said connector body, said adapter portion having an outer wall disposed proximate said beveled end and extending past said beveled end such that said beveled end is recessed within said adapter portion, an insertion space being defined between said beveled end and said outer wall; said outer wall being insertable into said recess area and said insertion space being receivable of said second inner sidewall so as to retain and seal said connector device with said insert body when connected in a dispensing position;

whereby said opening of said insert body and said opening of said connector device defining a flow passage therethrough when connected in the dispensing position.

2. The coupling apparatus as claimed in claim 1, wherein said insert body being connectable to a fluid source and said connector device being connectable to a fluid line.

3. The coupling apparatus as claimed in claim 1, wherein said insert body having a protective cap disposed at said second end and covering said recess area and second inner sidewall.

4. The coupling apparatus as claimed in claim 1, wherein said second inner sidewall includes a sealing membrane disposed over said aperture and connected to said second inner sidewall proximate said second end of the insert body, said sealing membrane defining a puncture seal.

5. The coupling apparatus as claimed in claim 1, wherein said second inner sidewall being recessed within said second end.

6. The coupling apparatus as claimed in claim 1, wherein said insert body includes at least one support member disposed at said first end and opposite said recess area, the at least one support member being connected between said first inner sidewall and said second inner sidewall.

7. The coupling apparatus as claimed in claim 6, wherein said at least one support member being at least one brace extending in a direction transverse to said first and second inner sidewalls.

8. The coupling apparatus as claimed in claim 7, wherein said at least one brace being a plurality of braces.

9. The coupling apparatus as claimed in claim 7, wherein said at least one brace being at least one pair of oppositely disposed braces.

10. The coupling apparatus as claimed in claim 1, wherein said connector device being connectable to a fluid dispensing system.

11. The coupling apparatus as claimed in claim 1, wherein said connector body and said adapter portion being integrally formed as a single piece structure requiring no assembly.

12. The coupling apparatus as claimed in claim 1, wherein said connector body and said adapter portion being formed as a two piece structure, said outer wall of said adapter portion being a tubing portion with said connector body inserted therein, such that said insertion space being defined between said tubing portion and said beveled end.

13. The coupling apparatus as claimed in claim 1, wherein said connector device including at least one retention barb disposed proximate said first end of the connector device and being engageable with at least one of said first inner sidewall or said second inner sidewall of said insert body.

14. The coupling apparatus as claimed in claim 13, wherein said at least one retention barb being engageable with said insert body only, whereby a connection between said retention barb and said insert body is a part line free sealing surface.

15. The coupling apparatus as claimed in claim 13, wherein said at least one retention barb being disposed on said connector body.

16. The coupling apparatus as claimed in claim 13, wherein said at least one retention barb being disposed on said adapter portion.

17. The coupling apparatus as claimed in claim 1, wherein said connector device being disposable after one time use.

18. The coupling apparatus as claimed in claim 1, wherein said connector body being formed of an integrally molded material and being disposable after one time use.

* * * * *